US005170604A

United States Patent [19]

Hedly

[11] Patent Number: 5,170,604

[45] Date of Patent: Dec. 15, 1992

[54] WALL PANEL SYSTEM AND FASTENER THEREFOR

[75] Inventor: Atwell B. Hedly, Swansea, Mass.

[73] Assignee: Tamer Industries, Inc., Pawtucket, R.I.

[21] Appl. No.: 747,945

[22] Filed: Aug. 21, 1991

[51] Int. Cl.[5] ..... E04B 1/61

[52] U.S. Cl. ..... 52/584; 52/464; 52/467; 52/772; 52/775; 52/778

[58] Field of Search ..... 52/465, 466, 467, 468, 52/768, 769, 772, 775, 777, 584, 80, 81, 82, 461, 463, 464, 778

[56] References Cited

U.S. PATENT DOCUMENTS

| | | | |
|---|---|---|---|
| 1,429,018 | 9/1922 | Cibulas | 52/467 |
| 1,772,068 | 8/1930 | Cibulas | 52/467 |
| 2,055,127 | 9/1936 | Goodwin | 52/467 |
| 2,996,845 | 8/1961 | Cipriani et al. | 52/466 |
| 3,267,631 | 8/1966 | Hammitt | 52/584 |
| 3,432,196 | 3/1969 | Marchiorello | 52/584 |

*Primary Examiner*—Michael Safavi

*Attorney, Agent, or Firm*—Salter, Michaelson & Benson

[57] ABSTRACT

Wall panel system having a fastener including a clamping plate, a bolt, and a locking bar mounted on the bolt, wherein the plate has two spaced, parallel tongues that extend through a gap between panel elements and has a stop to regulate swinging of the locking bar about the bolt from a first position extending between the tongues to a second position bridging the gap.

11 Claims, 2 Drawing Sheets

WALL PANEL SYSTEM AND FASTENER THEREFOR

BACKGROUND OF THE INVENTION

In the installation of modular wall systems, it is common practice to provide a plurality of similar panel elements and to join them in order to complete a wall assembly. These systems are used to provide machine enclosures, booths, office rooms, work stations, and the like. The panel elements are joined in various ways, including simple nut-and-bolt means. In order to overcome some of the disadvantages of such means, various forms of fasteners have been developed for this purpose. For instance, the U.S. Pat. of Daw et al No. 4,909,013 shows an extension of the nut-and-bolt system in which the nut is in the form of a large rectangular element having grooves that engage flanges on panel elements to be joined. Such structures developed in the past have suffered from a number of disadvantages, including the fact that they have been complex and expensive. Some of the systems have required more than one person to assemble, because one person has been required to work at the rear of the assembly, while another person operates the fastener from the front. Other systems have had fasteners made up of a number of unassembled small parts that are easily mislaid or lost. These and other difficulties experienced with the prior art devices have been obviated in a novel manner by the present invention.

It is, therefore, a primary object of the invention to provide a wall panel system that includes a fastener that permits assembly of panels by a single person from the front of the system without any alignment problems.

Another object of this invention is the provision of a wall panel system including a fastener whose parts need not be disassembled before being applied to panel elements.

Another object is the provision of a wall panel system including a fastener that can be pre-adjusted so as to minimize the number of turns required to effect locking of the panels to each other.

A further object of the present invention is the provision of a fastener for use in a wall panel system, which fastener is simple and rugged in construction, which can be easily manufactured from readily-available materials, and which is capable of a long life of useful service with a minimum of maintenance.

A still further object of the invention is the provision of a wall panel system which is aesthetically pleasing in appearance.

It is a further object of the invention to provide a fastener for a wall system, which fastener consists of a number of small parts which are completely assembled at the factory, so that the parts cannot be mislaid or lost during the application of the fastener to panel elements.

With these and other objects in view, as will be apparent to those skilled in the art, the invention resides in the combination of parts set forth in the specification and covered by the claims appended hereto.

SUMMARY OF THE INVENTION

In general, the invention relates to a wall panel system comprising a plurality of panel elements located adjacent one another in the same general plane, the panel elements having spaced, parallel edges defining a narrow gap between them. The system includes a fastener having a clamping plate for contact with outside surfaces of the panel elements, the plate having two spaced, parallel tongues adapted to extend through the gap to determine the width of the gap. A bolt extends through the clamping plate having a head located on the outside of the plate and a locking bar threaded on the bolt. The bar has a width that is less than the distance between the tongues and has a length that is greater than the width of the gap, so that it can swing from a first position between the tongues to a second position at a right angle to the first position. A stop extends rearwardly from the clamping plate for engagement by one edge of the locking bar when it is moved to the first position and for engagement by the other edge of the locking bar when it is moved to the second position. A locking nut is threadedly mounted on the bolt, and a first coil spring of frusto-conical shape is carried on the bolt between the rear surface of the clamping plate and the locking bar, while a second similar coil spring is positioned on the bolt between the locking bar and the nut.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
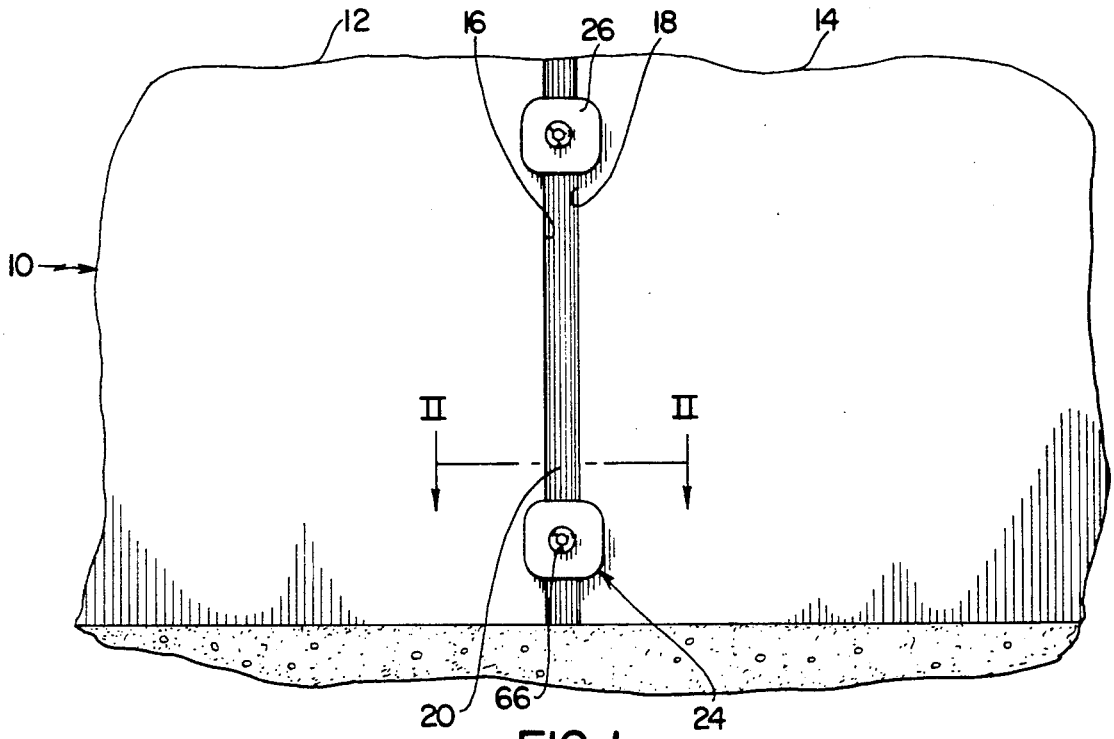
FIG. 1 is a front elevational view of a wall panel system incorporating the principles of the invention.

Referring first to FIG. 1, wherein are best shown the general features of the invention, the wall panel system, indicated generally by the reference numeral 10, is shown as including two panel elements 12 and 14 located adjacent to one another in the same general plane. The panels have spaced, parallel edges 16 and 18, respectively, that define a narrow gap 20 between them. Several fasteners, such as the fastener 24, hold the panels in a fixed relationship so as to define a wall or enclosure.

Figure 2:
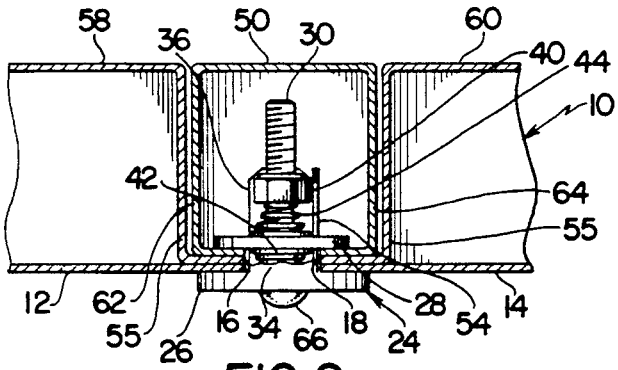
FIG. 2 is a horizontal sectional view of the invention, taken on the line II—II of FIG. 1, with a portion broken away for purposes of illustration.
Figure 3:
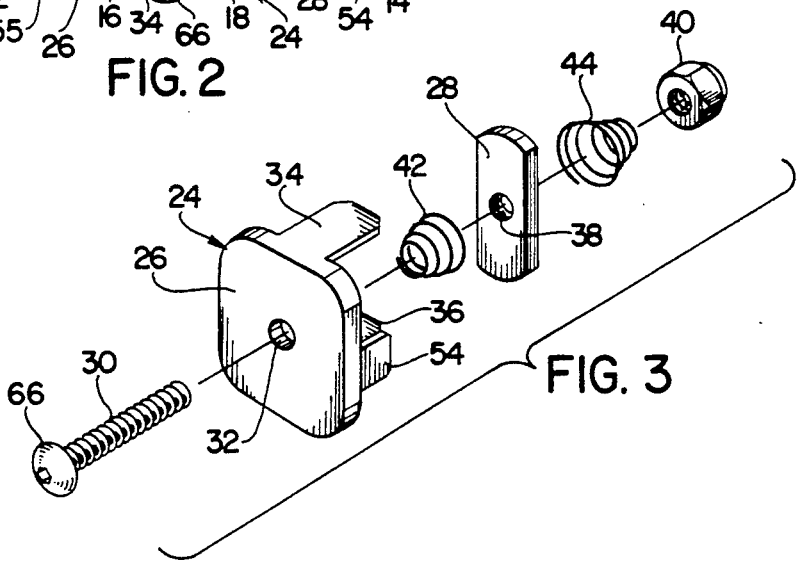
FIG. 3 is an exploded perspective view of a fastener forming part of the invention.
Figure 4:
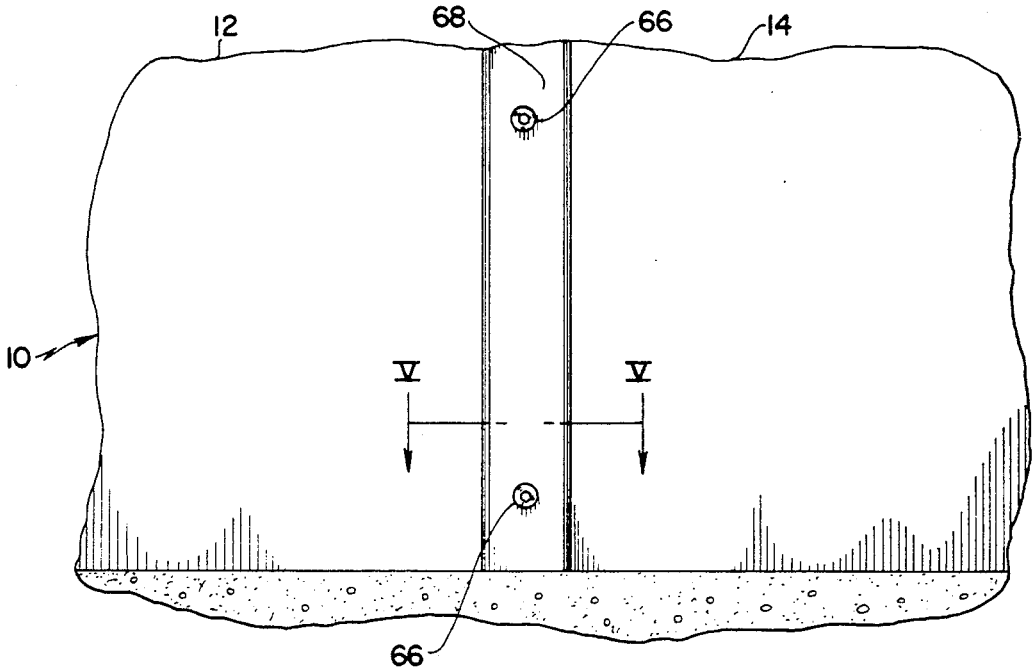
FIG. 4 is a front elevational view of a modified form of the invention.
Figure 5:
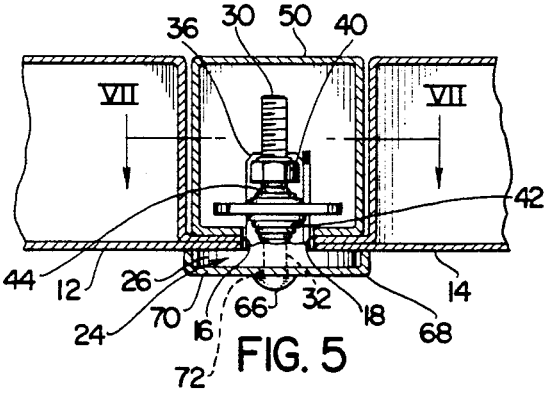
FIG. 5 is a horizontal sectional view of the invention, taken on the line V—V of FIG. 4 with the locking bar shown in its lock position and with a portion broken away for purposes of illustration.
Figure 6:
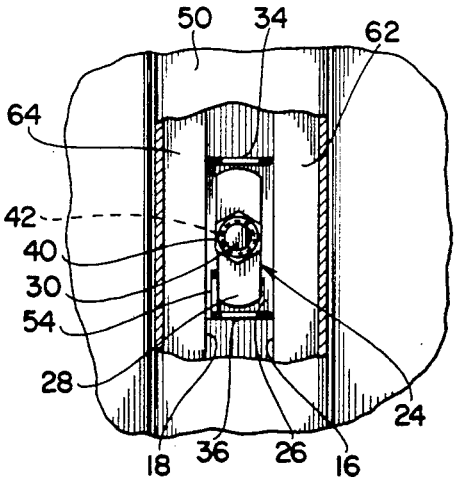
FIG. 6 is a fragmentary vertical view of the invention showing the locking bar in its non-lock position.
Figure 7:
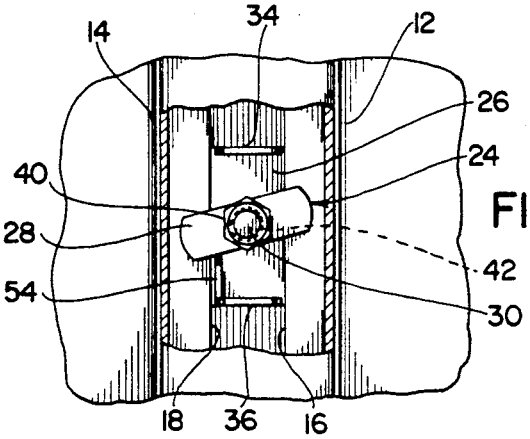
FIG. 7 is a sectional view of the invention taken on line VII—VII of FIG. 5.

As shown in FIGS. 2 and 3, the fastener 24 includes a clamping plate 26, a locking bar 28, and a threaded bolt 30. The inner surface of clamping plate 26 contacts marginal portions of the outer surfaces of the panel elements 12 and 14, thus bridging the gap 20. An aperture 3 is positioned substantially centrally of plate 26 in alignment with the midpoint of the gap. The clamping plate has two spaced, parallel tongues 34 and 36 extending through the gap 20 to the rear side of the panel elements, with the side edges of said tongues preferably abutting the edges 16, 18 so as to define the width of gap 20. The locking bar 28 has a threaded central aperture 32 through which bolt 30 extends in threaded engagement.

A nut 40 is threadedly attached to the bolt 30, while friction springs 42 and 44 are positioned on the bolt between the clamping plate and the locking bar and between the locking bar and the nut, respectively. These springs are coil springs of frusto-conical configuration. In the version of the invention shown in FIGS. 1-3, the panel elements 12 and 14 are shown as flat walls or panels sandwiched between clamping plate 26 and flange parts 55 of hollow walls 58 and 60, which walls have a hollow post 50 of generally square cross-sectional shape located therebetween, said post having inwardly extending flanges 62 and 64, the edges of which also abut the side edges of tongues 34, 36. It should be noted that the panels 12, 14 are not actually essential to the integrity of the system, and may be eliminated, although for aesthetic reasons, and in order to provide a substantially flat overall wall, it is preferred that they be used.

FIG. 3 shows the details of the fastener 24, which is intended for use in any wall panel system in which two panel elements are located adjacent one another in the same general plane and the panel elements have spaced, parallel edges defining a narrow gap between them. The fastener includes the clamping plate 26 for contacting outside surfaces of the panel elements and the two spaced, parallel tongues 34 and 36 which are adapted to extend through the gap and to determine the width of the gap. The plate has the bore 32 whose center is located midway between the tongues and is intended to be located midway between the edges defining the gap. The bolt 30 extends through the bore with a head 66 to be located on the outside of the clamping plate, and the locking bar 28 is threaded on the bolt 30 and has a length that is less than the distance between the tongues 34, 36, although longer than the width of the gap, so that it can swing from a first position between the tongues to a second position bridging the gap at a right angle to the first position. A stop 54 extends rearwardly from the clamping plate and is intended to be engaged by one end of the locking bar when it is moved to the first position and engaged by the other end of the locking bar when it is moved to the second position so as to define the limits of movement of the locking bar. The coil spring 42 has a frusto-conical shape and is carried on the bolt between the rear surface of the clamping plate and the locking bar. In the version of the invention shown in FIGS. 1-3, the nut 40 is mounted on the bolt 30 rearwardly of the locking bar and the frusto-conical coil spring 44 is carried on the bolt between the locking bar and the nut.

Each of the tongues 34 and 36 is formed with spaced, parallel edges, the distance between the edges being the desired width of the gap between the edges of the panel 13 elements. The stop 54 is preferably fastened to the tongue 36, is of generally rectangular shape, extends at a right angle to the tongue, and has a width that is approximately one-half the distance from the centerline of the bolt to the tongue. The locking bar 28 is narrower than the width of the gap, so that, when the locking bar is in the first position, it can pass through the gap.

The operation of the invention will now be readily understood in view of the above description. The panel elements 12 and 14 are brought together in the same plane with their edges 16 and 18 in spaced, parallel relationship and a gap is formed of the desired width. A plurality of fasteners 24 are located in the gap in vertically spaced relation. The width of the tongues 34 and 36 is used to locate the edges 16 and 18, and the bolt 30, which has a socket head 66, is then turned. This serves to turn the locking bar 28 from its vertical position (in which it extends between the tongues) to a horizontal position (shown in FIG. 2) where it bridges the ga 20 and engages the back surfaces of the panel elements. As the locking bar is turned in this way, it eventually reaches a final position against the stop 54, so that further turning of the bolt 30 causes the locking bar only to advance (without rotating) toward the back surfaces of the panel elements. Eventually, the panel elements are tightly clamped between the locking bar and the clamping plate. It should be noted that the springs 42 and 44 serve to provide sufficient friction to hold the locking bar in place in either the first position (between the tongues) or the second position (bridging the gap), and also provide sufficient friction so that when bolt 30 is first turned, the locking bar swings from the aforesaid first position until it engages stop 54, at which time it is in the aforesaid second position.

The initial position of the locking bar along the bolt 30 may be pre-adjusted so as to minimize the number of turns required to effect tight clamping of the assembly. The position of the nut determines the amount of friction provided by the conical spring 44, while the position of locking bar 28 on bolt 30 determines the tension of spring 42. The friction imparted by spring 42 assures that turning of the bolt 30 causes the locking bar to turn in the direction that the bolt is turned. Once the locking bar engages the stop 54, the friction of the spring is overcome, and further turning of the bolt causes the locking bar to proceed either toward or away from the panel elements. In other words, the locking bar clamps the panel elements tightly or moves away from them for removal of the fastener and disassembly of the panels.

The advantages of the invention are evident from the above description of the operation. It is clear that once a rough application of the fastener 24 has been made, it is possible to tighten it from the front side alone. In other words, it is not necessary to hold any of the fastener elements at the back side of the panels. A single person can, therefore, assemble the panels and completely tighten the locking bar in place by turning the bolt 30. The tongues 34 and 36 serve to determine the distance between the edges 16 and 18 and to determine the width of the gap 20. There is no necessity for forming the panel elements in any special form; in the preferred embodiment of the invention, the panel elements are formed with plain, straight edges. Any number of fasteners can be used, depending on the height and nature of the installation. The clamping plate can be formed in any decorative form, so that the exposed part of the fastener has aesthetic appeal and does not have any sharp edges or appendages that could cause injury or damage to clothing. It should also be noted that all the operative parts of the fastener can leave the factory in assembled form and that there is no need to remove them before applying the fastener to panel elements. Therefore, the likelihood of losing small parts is eliminated. The use of conical springs gives the advantage that they can be compressed a considerable amount without engagement between adjacent coils. This means that damage to the spring will not take place even when the springs are tightly compressed. Furthermore, by adjusting the position of nut 40 on bolt 30, the spring 44 can always be maintained under tension, no matter what the initial adjusted position of locking bar 28 on bolt 30 may be, thus preventing the locking bar from flopping around between its first and second positions.

FIGS. 4 through 7 show a variation of the invention which differs from FIGS. 1 through 3 only in that a decorative cover or channel 68 in the form of an elongated U-shaped channel bridges the gap 20. Specifically, as will be seen most clearly in FIGS. 4 and 5, the depth of channel 68 is approximately equal to the thickness of plate 26 so as to snugly receive same, the outer wall 70 of channel 68 having a plurality of openings 72 therein in alignment with the openings 32 whereby bolts 30 extend through aligned openings 72 and 32 so that only the bolt heads 66 are visible from the front side of the system. Thus when, as aforesaid, the fasteners 24 are turned to effect clamping of the post flanges 62, 64 and the flange parts 55, as well as panels 12 and 14, if the latter are used, between plates 26 and locking bars 28, the cover or channel 68 is also clamped therebetween, said channel covering the gap 20 and also covering the clamping plates 26, so as to provide a more aesthetically pleasing appearance to the system.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Wall panel system, comprising (a) two panel elements located adjacent to one another in the same general plane, the panels having spaced, parallel edges defining a narrow gap therebetween, (b) a fastener holding the panels in fixed relationship, the fastener including a clamping plate, a locking bar, and a bolt, the clamping plate contacting one side surface of both panel elements, bridging the gap, and having an aperture aligned with the gap, the plate having means extending through the gap to the other side of the panel elements, said means defining the width of the gap, the locking bar having a threaded central aperture, and the bolt extending through the aperture in the clamping plate and being threaded to the threaded aperture in the locking bar, and (c) a nut threaded on the bolt, and friction springs lie on the bolt between the clamping plate and the locking bar and between the locking bar and the nut, respectively.

2. Wall panel system as recited in claim 1, wherein the springs are of frusto-conical form.

3. Wall panel system as recited in claim 1, wherein said means comprise a pair of spaced parallel tongues the width of which define the width of the gap.

4. Wall panel system as recited in claim 1, wherein an elongated cover extends over the outer surface of the panel elements and covers the fastener and gap, and wherein the cover has an aperture in alignment with the clamping plate aperture through which the said bolt extends.

5. Fastener for use in a wall panel system in which two panel elements are located adjacent one another in the same general plane, the panel elements having spaced, parallel edges defining a narrow gap between them, comprising:

(a) a clamping plate contacting outside surfaces of the panel elements and having two spaced, parallel tongues adapted to extend through the gap defining the width of the gap, the plate having a bore located between the tongues and between the edges defining the gap, (b) a bolt extending through the bore with a head located on the outside of the clamping plate, (c) a locking bar threaded on the bolt and having a length that is less than the distance between the tongues and longer than the width of the gap, so that it can swing from a first position between the legs to a second position substantially perpendicular to the first position, and (d) a stop extending rearwardly from the clamping plate to be engaged by one end of the locking bar when it is moved to the first position and engaged by the other end of the locking bar when it is moved to the second position.

6. Fastener as recited in claim 5, wherein a coil spring of frusto-conical shape is carried on the bolt between the rear surface of the clamping plate and the locking bar.

7. Fastener as recited in claim 5, wherein a nut is mounted on the bolt rearwardly of the locking bar, and wherein a frusto-conical coil spring is carried on the bolt between the locking bar and the nut.

8. Fastener as recited in claim 5, wherein the tongues are formed with spaced, parallel edges, the distance between the edges being the desired width of the gap between the edges of the panel elements.

9. Fastener as recited in claim 5, wherein the stop is fastened to one of the tongues, is of generally rectangular shape, extends at a right angle to the said one of the tongues, and has a width that is approximately onehalf the distance from the centerline of the bolt to the said one of the tongues.

10. Fastener as recited in claim 5, wherein the locking bar is narrower than the width of the gap, so that, when the locking bar is in the first position, it can pass through the gap.

11. Wall panel system, comprising (a) two panel elements located adjacent to one another in the same general plane, the panels having spaced, parallel edges defining a narrow gap therebetween, (b) a fastener holding the panels in fixed relationship, the fastener including a clamping plate, locking bar, and a bolt, the clamping plate contacting one side surface of both panel elements, bridging the gap, and having an aperture aligned with the gap, the plate having means extending through the gap to the other side of the panel elements, said means defining the width of the gap, the locking bar having a threaded central aperture, and the bolt extending through the aperture in the clamping plate and being threaded to the threaded aperture in the locking bar, and (c) stop means carried by said plate for limiting rotatable movement of said locking bar from a first position wherein it extends longitudinally within said gap to a second position wherein it bridges said gap.

* * * * *